US008636278B2

(12) United States Patent
Emoto et al.

(10) Patent No.: US 8,636,278 B2
(45) Date of Patent: Jan. 28, 2014

(54) FEEDING DEVICE AND IMAGE FORMING APPARATUS HAVING THE SAME

(75) Inventors: Yuki Emoto, Kawasaki (JP); Yasuyuki Asai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 12/946,218

(22) Filed: Nov. 15, 2010

(65) Prior Publication Data

US 2011/0127713 A1 Jun. 2, 2011

(30) Foreign Application Priority Data

Nov. 27, 2009 (JP) ..... 2009-270127

(51) Int. Cl.
*B65H 3/52* (2006.01)

(52) U.S. Cl.
USPC ..... 271/124; 271/121; 271/125; 271/122; 271/167

(58) Field of Classification Search
USPC ..... 271/121, 124, 125, 122, 145, 167
See application file for complete search history.

(56) References Cited

U.S. PATENT DOCUMENTS

| | | | | |
|---|---|---|---|---|
| 5,857,671 | A * | 1/1999 | Kato et al. | 271/10.11 |
| 5,895,040 | A * | 4/1999 | Oleksa et al. | 271/124 |
| 6,331,002 | B1 | 12/2001 | Yoshino et al. | |
| 6,824,132 | B2 | 11/2004 | Asai et al. | |
| 7,000,916 | B2 | 2/2006 | Asada et al. | |
| 7,401,774 | B2 * | 7/2008 | Ginzton | 271/124 |
| 7,543,814 | B2 * | 6/2009 | Qi et al. | 271/167 |
| 7,959,148 | B2 * | 6/2011 | Alsip et al. | 271/121 |
| 2000/4001703 | | 1/2004 | Asada et al. | |
| 2004/0032077 | A1 * | 2/2004 | Oh et al. | 271/121 |
| 2004/0251592 | A1 * | 12/2004 | Ruhe et al. | 271/109 |
| 2007/0222139 | A1 * | 9/2007 | Hotani | 271/121 |
| 2010/0156033 | A1 * | 6/2010 | Lee | 271/121 |

FOREIGN PATENT DOCUMENTS

| | | | |
|---|---|---|---|
| CN | 1313199 | A | 9/2001 |
| JP | 11-011719 | | 1/1999 |
| JP | 2001-253580 | A | 9/2001 |
| JP | 2002-128304 | A | 5/2002 |
| JP | 2003-54781 | | 2/2003 |
| JP | 2004-051336 | A | 2/2004 |

OTHER PUBLICATIONS

Notification of First Office Action, People's Republic of China, Nov. 2, 2012.
Chinese Office Action issued in Counterpart Chinese Application No. 2010/10560973.2 dated Oct. 25, 2013.

* cited by examiner

*Primary Examiner* — Prasad Gokhale
(74) *Attorney, Agent, or Firm* — Fitzpatrick, Cella, Harper & Scinto

(57) ABSTRACT

The feeding device includes a storage unit, a feeding roller which rotates while contacting the uppermost sheet stored in the storage unit to move the uppermost sheet forward, a separation plate disposed forward in the movement direction of the uppermost sheet and provided with an inclined surface inclined with respect to the movement direction, and a separation auxiliary member is disposed along the inclined surface of the separation plate and operated by a force received when the uppermost sheet comes in contact. The separation auxiliary member includes a rotation shaft parallel with the inclined surface, and a first resistance part rotating about the rotation shaft as the center from an initial position projecting from the inclined surface to an embedded position embedded in the inclined surface as a friction coefficient of the first resistance part is higher than that of the inclined surface and the received force is increased.

6 Claims, 8 Drawing Sheets

FEEDING DEVICE AND IMAGE FORMING APPARATUS HAVING THE SAME

BACKGROUND OF THE INVENTION

1. Field of the Invention

The present invention relates to a feeding device and an image forming apparatus having the same, and more particularly, to a technique for separating sheets using an inclined surface separation method.

2. Description of the Related Art

In the past, an image forming apparatus such as an ink jet printer, a laser printer, a fax device, or a copying machine, has included a feeding device for feeding sheets to an image forming unit one by one. As the feeding device, there is an inclined surface separation-type feeding device which is provided with a separation member having a high friction coefficient on an inclined surface to increase separation performance.

FIG. 10 is a cross-sectional view illustrating the configuration of an inclined surface separation-type feeding device according to the related art. In the feeding device 100 illustrated in FIG. 10, sheets S are stacked and stored in a sheet feed tray 101. A feeding roller arm 104 that pivots according to the height of the stacked sheets is provided above the sheet feed tray 101. A feeding roller 105 is mounted on the front end of the feeding roller arm 104 and a drive shaft 106 is mounted to the rear end thereof. The feeding roller arm 104 holds the drive shaft 106 so as to be pivotable, and the rotating force of the drive shaft 106 is transmitted to the feeding roller 105 via gears (not shown). Then, the feeding roller 105 rotates while contacting the uppermost sheet S1 stacked in the sheet feed tray 101 and thus moves the sheet S1 forward.

Forward in the movement direction of the sheet S1, a separation plate 102 is disposed. The separation plate 102 is inclined at an angle of θ (see FIG. 10) which is an obtuse angle with respect to the stacking surface of the sheet S1 in the sheet feed tray 101, and as illustrated in FIG. 11, includes two separate inclined surfaces 102*a* and 102*b*. A separation auxiliary member 103 which is fixed to be parallel with the inclined surfaces 102*a* and 102*b* is interposed between the inclined surfaces 102*a* and 102*b*. The separation auxiliary member 103 includes members with higher friction coefficients than the inclined surfaces 102*a* and 102*b*. Moreover, FIG. 11 is a plan view of the separation plate 102 and the separation auxiliary member 103 in a direction (refer to an arrow C) allowing viewing of the separation plate 102 illustrated in FIG. 10 from above.

In the feeding device 100, as the front end of the sheet S1 comes in contact with the inclined surfaces 102*a* and 102*b* and the separation auxiliary member 103, the sheet S1 receives a reaction force from the inclined surfaces 102*a* and 102*b* and the separation auxiliary member 103. Accordingly, the front end of the sheet S1 is able to be bent, and thereafter, the sheet S1 is conveyed upward along the inclined surfaces 102*a* and 102*b* due to the rotation of the feeding roller 105. Here, even through the sheet S is a sheet with a low rigidity, such as a thin paper, the sheet S1 is easily separated from other sheets by the separation auxiliary member 103.

A feeding device provided with, for example, the separation auxiliary member 103 in a part of an inclined surface on which sheets are conveyed is disclosed in Japanese Patent Application Laid-Open No. H11-011719 or 2003-054781. In the feeding device disclosed in Japanese Patent Application Laid-Open No. H11-011719, an insert is provided which projects from the inclined surface according to the rigidity of a sheet or recedes to a position flush with the inclined surface so as to be changed in shape. In the feeding device disclosed in Japanese Patent Application Laid-Open No. H11-011719, in a case where a sheet with high rigidity such as a thick paper is conveyed, the insert is pressed due to the rigidity of the sheet. Therefore, the reaction force (resistance) exerted on the sheet during conveyance is reduced as compared with a case where the insert projects from the inclined surface. Accordingly, a sheet feed failure of a sheet with high rigidity is prevented.

In a feeding device disclosed in Japanese Patent Application Laid-Open No. 2003-054781, a link mechanism for elevating a sheet feed tray is provided. In the feeding device disclosed in Japanese Patent Application Laid-Open No. 2003-054781, in a case where a sheet with low rigidity is conveyed, the link mechanism is lifted. Then, a separation pad with a higher friction coefficient than the inclined surface is disposed on a part of the inclined surface. On the other hand, in the case where a sheet with low rigidity is conveyed, the link mechanism is lowered. As described above, stable sheet feeding is implemented by selectively using the separation pad according to the rigidity of the sheet.

However, in the feeding device disclosed in Japanese Patent Application Laid-Open No. H11-101719, when a sheet with high rigidity is conveyed along the inclined surface, the insert and the sheet are not completely in non-contact with each other. This is because the insert recedes to be flush with the inclined surface and does not become hidden inside the inclined surface, although the front end of the sheet directly presses the insert. This always causes friction of the insert during conveyance of the sheet and thus is insufficient as a measure against sheet feed failure.

On the other hand, in the feeding device disclosed in Japanese Patent Application Laid-Open No. 2003-54781, when a sheet with high rigidity is conveyed along the inclined surface, the separation pad and the sheet are completely in non-contact with each other as a result of the link mechanism. However, the feeding device requires a large-scale mechanism for elevating the sheet feed tray, so that there is a problem in that costs are increased.

SUMMARY OF THE INVENTION

An object of the invention is to provide a feeding device which is very economical and is able to perform stable feeding regardless of the rigidity of sheets, and an image forming apparatus having the same.

In order to accomplish this object, according to an aspect of the invention, the feeding device includes: a storage unit in which sheets are stacked and stored; a feeding roller which rotates while contacting the uppermost sheet stored in the storage unit to move the uppermost sheet forward; a separation plate which is disposed forward in the movement direction of the uppermost sheet and is provided with an inclined surface that is inclined with respect to the movement direction; and a separation auxiliary member which is disposed along the inclined surface of the separation plate and is operated by a force that is received when the uppermost sheet comes in contact, wherein the separation auxiliary member includes a rotation shaft which is parallel with the inclined surface of the separation plate, and a first resistance part, which rotates about the rotation shaft as the center from an initial position projecting from the inclined surface to an embedded position embedded in the inclined surface, has a friction coefficient of the first resistance part higher than that of the inclined surface and thus the received force is increased.

According to the aspect of the invention, the separation auxiliary member is operated using the force exerted when the sheet comes in contact, so that a large-scale mechanism such as a mechanism for elevating the storage unit is not needed. In addition, when a sheet is conveyed along the inclined surface of the separation plate, as the force exerted when the sheet comes in contact is increased, an area of the first resistance part contacting the sheet is reduced, and finally the first resistance part is in a completely non-contact state. Accordingly, in the case where the rigidity of a sheet is low, multi feeding rarely occurs due to the first resistance part, and in the case where the rigidity of the sheet is high, a feeding failure rarely occurs. Therefore, the feeding device is very economical and enables stable feeding regardless of the rigidity of the sheet.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
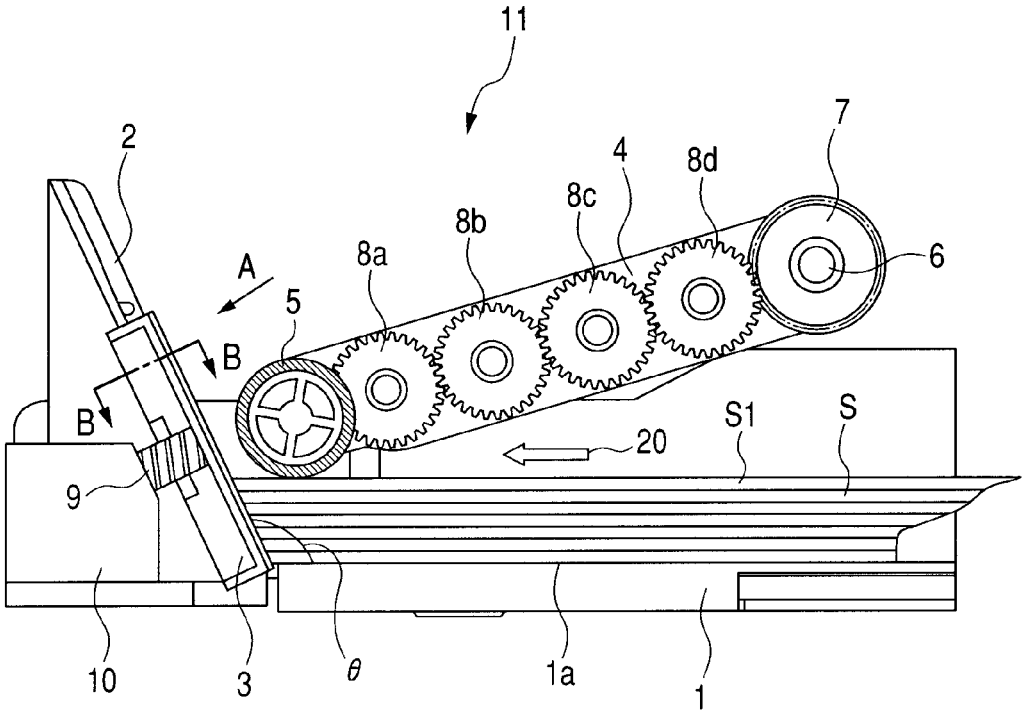
FIG. 1 is a cross-sectional view illustrating a feeding device according to an embodiment of the invention.

FIG. 1 is a cross-sectional view illustrating a feeding device according to an embodiment of the invention.

In the feeding device 11 according to the embodiment illustrated in FIG. 1, a sheet feed tray 1 is a storage unit in which sheets S are stacked and stored. An upper side of the sheet feed tray 1 is open, and a feeding roller arm 4 that pivots according to the height of the stacked sheets is provided above the sheet feed tray 1. A feeding roller 5 is mounted on the front end of the feeding roller arm 4, and a drive shaft 6 and a drive gear 7 that rotates about the drive shaft 6 as the center are mounted on the rear end thereof. The feeding roller arm 4 and the drive gear 7 are connected via idler gears 8*a*, 8*b*, 8*c*, and 8*d* held in the feeding roller arm 4. The feeding roller arm 4 holds the feeding roller 5 so as to be pivotable and is held in order to rotate about the drive shaft 6. When the drive shaft 6 rotates, the rotating force of the drive gear 7 fixed to the drive shaft 6 is transmitted to the feeding roller 5 via the idler gears 8*a* to 8*d*. Then, the feeding roller 5 rotates while contacting the uppermost sheet S1 stacked in the sheet feed tray 1 in order to move the sheet S1 forward. In addition, the drive shaft 6 is controlled by a drive mechanism (not shown) that is able to control the drive shaft 6.

Figure 2:
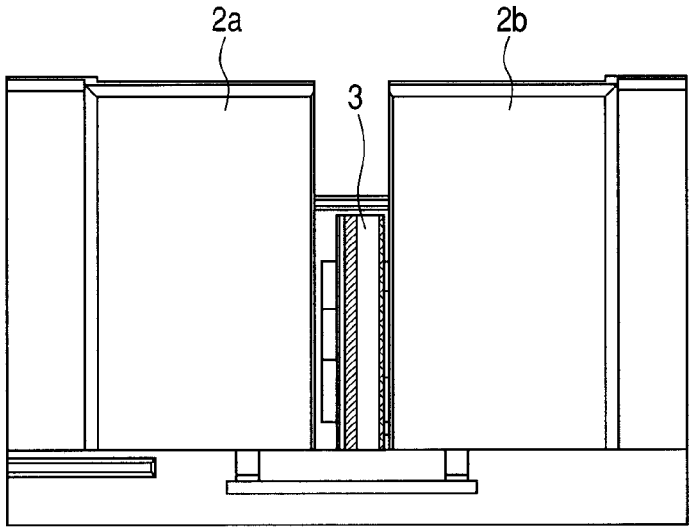
FIG. 2 is a plan view of a separation plate and a separation auxiliary member illustrated in FIG. 1.

Forward in the movement direction (see arrow 20) of the sheet S1, a separation plate 2 is disposed. The separation plate 2 is inclined with respect to the movement direction of the sheet S1 so as to easily separate the sheet S1 from other sheets. According to this embodiment, the separation plate 2 is inclined at an angle of θ which is an obtuse angle with respect to a sheet stacking surface 1*a* of the sheet feed tray 1. The separation plate 2 is provided with two separate inclined surfaces 2*a* and 2*b* as illustrated in FIG. 2. A separation auxiliary member 3 is interposed between the inclined surfaces 2*a* and 2*b*. In addition, FIG. 2 is a plan view of the separation plate 2 and the separation auxiliary member 3 in a direction (see arrow A) allowing viewing of the separation plate 2 illustrated in FIG. 1 from above.

Figure 3:
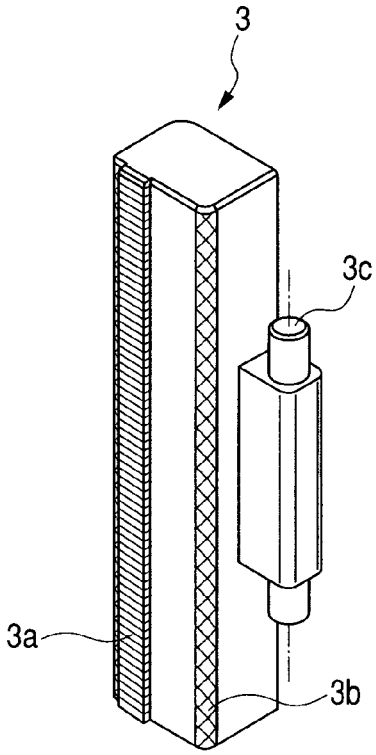
FIG. 3 is a perspective view illustrating the configuration of the separation auxiliary member of the feeding device according to the embodiment.

Here, the separation auxiliary member 3 will be described in detail. FIG. 3 is a perspective view illustrating the configuration of the separation auxiliary member 3. As illustrated in FIG. 3, the separation auxiliary member 3 is a component that is disposed along the inclined surfaces 2*a* and 2*b*, is operated when coming in contact with the sheet S1 and receives force, and includes a high resistance part (first resistance part) 3*a*, a low resistance part (second resistance part) 3*b*, and a rotation shaft 3*c*. The high resistance part 3*a* includes an uneven surface in order to easily separate the sheet S1 from other sheets, and the friction coefficient of the uneven surface is higher than that of the inclined surfaces 2*a* and 2*b*. In addition, the high resistance part 3*a* rotates about the rotation shaft 3*c* as the center from an initial position projecting from the inclined surfaces 2*a* and 2*b* toward an embedded position embedded in the inclined surfaces 2*a* and 2*b* as the rigidity of the sheet S is increased. The low resistance part 3*b* is provided between the high resistance part 3*a* and the rotation shaft 3*c*. The low resistance part 3*b* includes a surface that has a higher friction coefficient than that of the inclined surfaces 2*a* and 2*b* and a lower friction coefficient than that of the high resistance part 3*a*. In addition, the low resistance part 3*b* also rotates about the rotation shaft 3*c* as the center. The high resistance part 3*a*, the low resistance part 3*b*, and the rotation shaft 3*c* are arranged on the plane or in the axis parallel to the inclined surfaces 2*a* and 2*b* and are implemented to always perform the same operation regardless of the contact position of the separation auxiliary member 3 and the front end of the sheet S. In addition, in the separation auxiliary member 3, the high resistance part 3*a* is disposed at a position further from the rotation shaft 3*c* than the low resistance part 3*b*. This is because the high resistance part 3*a* needs to be embedded in the inclined surfaces 2*a* and 2*b* in advance of the low resistance part 3*b* when the high resistance part 3*a* and the low resistance part 3*b* integrally rotate about the rotation shaft 3*c* as the center.

Figure 4A:
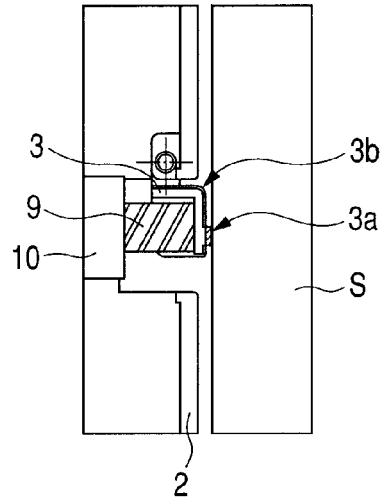
FIGS. 4A, 4B and 4C are cross-sectional views taken along the section line B-B of FIG. 1.
Figure 4B:
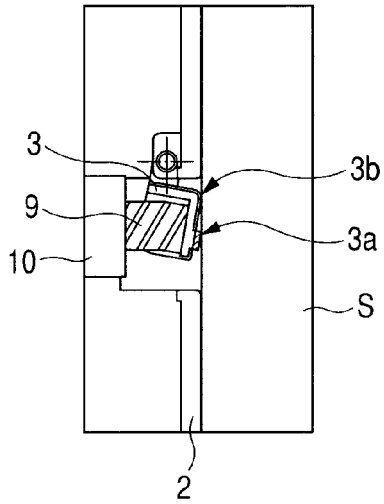
Figure 4C:
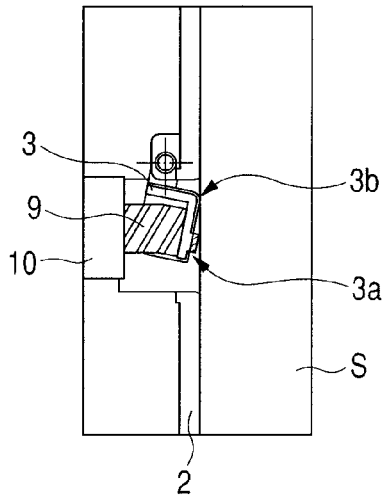

Here, a positional relationship between the inclined surface 2 and the separation auxiliary member 3 will be described with reference to FIGS. 4A to 4C. FIGS. 4A to 4C are cross-sectional views taken along the section line B-B of FIG. 1. The separation auxiliary member 3 is switched according to the rigidity of the sheet S between the first to third states respectively illustrated in FIGS. 4A to 4C. The separation auxiliary member 3 is provided with a biasing spring 9 as a biasing unit for biasing the high resistance part 3*a* and the low resistance part 3*b* as illustrated in FIGS. 4A to 4C. The biasing spring 9 biases the high resistance part 3*a* and the low resistance part 3*b* from the rear side as viewed from the contact surfaces thereof with the sheet S. In addition, one end of the biasing spring 9 is fixed by a spring supporting boss 10. Switching of the separation auxiliary member 3 between the first to third states is controlled by changing the biasing force of the biasing spring 9.

FIG. 4A illustrates the first state of the separation auxiliary member 3. In the first state, the high resistance part 3*a* projects most with respect to the inclined surfaces 2*a* and 2*b*. In the first state, the sheet S comes in contact with the high resistance part 3*a* when the sheet S is conveyed along the inclined surfaces 2*a* and 2*b*, so that high conveying resistance occurs during conveyance. Accordingly, the first state is suitable for feeding a sheet with low rigidity, such as a thin paper, and prevents problems such as double feeding. In addition, in the feeding device 11, the separation auxiliary member 3 is always maintained in the first state by the biasing spring 9 except during the feeding of the sheet S.

FIG. 4B illustrates the second state of the separation auxiliary member 3. In the second state, both the high resistance part 3*a* and the low resistance part 3*b* come in contact with the sheet S. In the second state, a portion of the high resistance part 3*a* is embedded (hidden) in the inclined surfaces 2*a* and 2*b*, and conveying resistance that occurs during conveyance becomes lower than that of the first state. In the second state, problems such as a feeding failure, which occurs due to high conveying resistance when a sheet with high rigidity is conveyed along the inclined surfaces 2*a* and 2*b*, are prevented. Here, in the second state, since the sheet S comes in contact with a portion of the high resistance part 3*a* during conveyance, the biasing spring 9 may be designed to exert a biasing force to correspond to a rigidity that does not interrupt conveyance even in the second state.

FIG. 4C illustrates the third state of the separation auxiliary member 3. In the third state, the high resistance part 3*a* is completely embedded in the inclined surfaces 2*a* and 2*b*, and only the low resistance part 3*b* comes in contact with the sheet S. In the third state, the high resistance part 3*a* and the sheet S are completely in non-contact with each other, the conveying resistance becomes even lower than that in the second state. Accordingly, the third state is suitable for feeding a sheet with very high rigidity such as a thick paper.

Next, a feeding operation of the feeding device will be described.

When the drive shaft 6 rotates, the rotating force of the drive shaft 6 is transmitted to the feeding roller 5 via the drive gear 7 fixed to the drive shaft 6 and the idler gears 8*a*, 8*b*, 8*c*, and 8*d*. Accordingly, the feeding roller 5 starts rotating (see FIG. 1). Here, since the feeding roller 5 contacts the uppermost sheet S1 of the sheets S stacked in the sheet feed tray 1, feeding force is exerted due to friction with the feeding roller 4 and the sheet S1 is moved forward in the direction of arrow 20. Thereafter, the sheet S1 receives a reaction force against the feeding force by the inclined surfaces 2*a* and 2*b* and the separation auxiliary member 3 for stopping the movement of the sheet S1. Here, on a sheet S2 (see FIGS. 5A and 5B) disposed immediately under the sheet S1, the feeding force due to the friction between the sheet S1 and the sheet S2 is exerted. When the sheet S2 is conveyed along the inclined surfaces 2*a* and 2*b* along with the sheet S1 due to the feeding force, double feeding occurs. Therefore, by using the reaction force which is exerted on the sheet S2 from the inclined surface 2 and the separation auxiliary member 3 against the feeding force, conveyance of the sheet S2 has to be prevented.

Here, with regard to the feeding force of the sheet S2 and the reaction force against the feeding force, the feeding force increases with the coefficient of friction between sheets. On the other hand, the reaction force increases with the rigidity of the sheet. That is, in consideration of a balance between the coefficient of friction between the sheets and the rigidity of the sheets, a sheet that is likely to generate double feeding is determined. It can be said that double feeding occurs easily when the coefficient of friction between sheets is high and a sheet with low rigidity is conveyed. In addition, the reaction force is changed due to the surface resistance of the inclined surfaces 2*a* and 2*b* and the separation auxiliary member 3, so that double feeding may be prevented by changing the resistance.

Figure 5A:
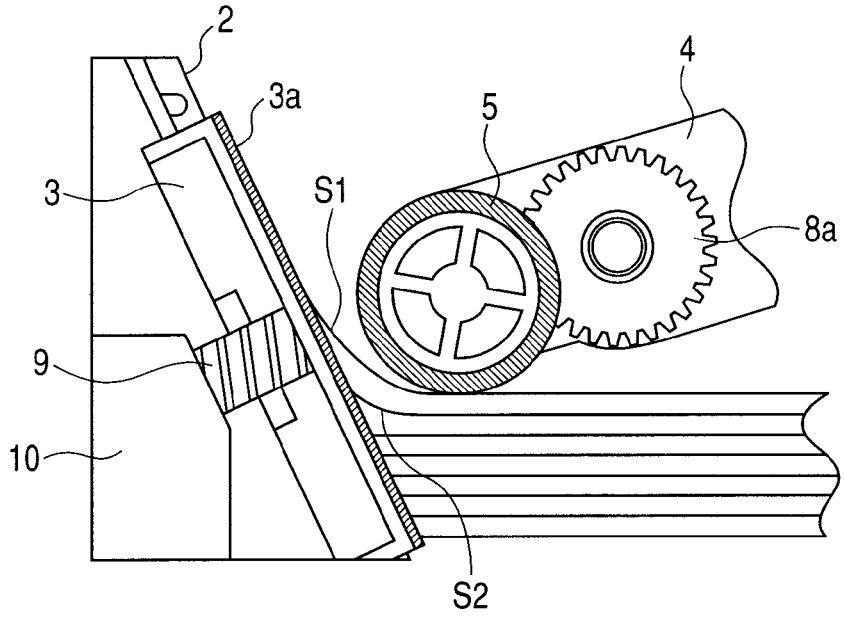
FIGS. 5A and 5B are cross-sectional views illustrating operation states of the separation auxiliary member when a sheet is conveyed.
Figure 5B:
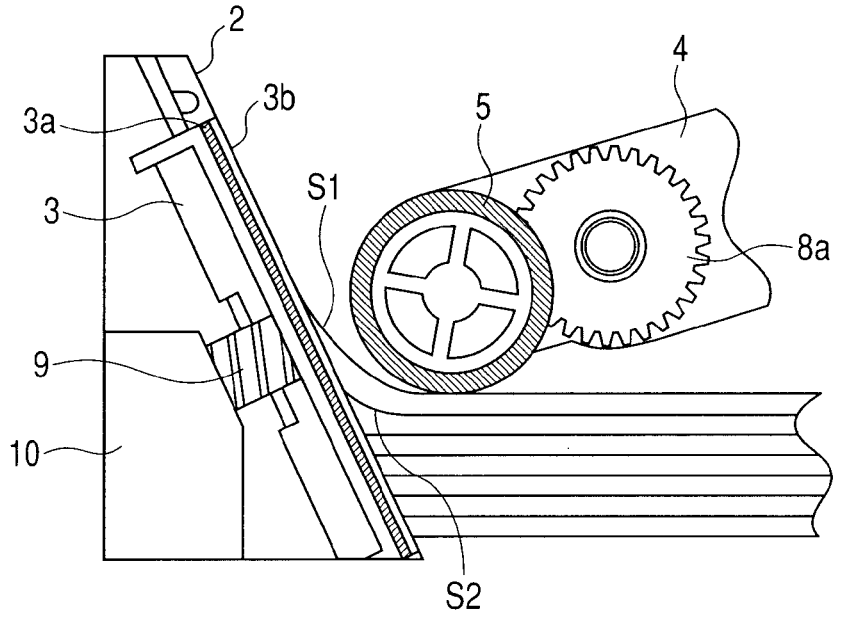

FIGS. 5A and 5B are cross-sectional views illustrating operation states of the separation auxiliary member 3 when sheets are conveyed along the inclined surfaces 2*a* and 2*b*.

FIG. 5A illustrates an operation state of the separation auxiliary member 3 when a sheet with low rigidity that is likely to generate double feeding is conveyed. During conveyance of a sheet with low rigidity, the high resistance part 3*a* of the separation auxiliary member 3 is allowed to project with respect to the inclined surfaces 2*a* and 2*b* to enable the sheet to come in contact with the high resistance part 3*a*. Here, the separation auxiliary member 3 is in the first state. Therefore, the reaction force against the feeding force is exerted by the high resistance part 3*a* on the sheet S2, so that double feeding is less likely to occur.

However, when a sheet with high rigidity is conveyed, in the case where the separation auxiliary member is in the first state, the reaction force which is increased due to the rigidity of the sheet is further amplified by the high resistance part 3*a* and becomes a very high force. The reaction force increased as described above has an adverse effect on the conveyance of the sheet S1, and there is a concern that problems such as a feeding failure occurs. Therefore, the amplification of the reaction force needs to be suppressed by changing the state of the separation auxiliary member 3.

FIG. 5B illustrates an operation state of the separation auxiliary member 3 during conveyance of a sheet with high rigidity. During conveyance of a sheet with high rigidity, a portion of the high resistance part 3*a* of the separation auxiliary member 3 is moved so as to be embedded in the inclined surfaces 2*a* and 2*b* and thus portions of the high resistance part 3*a* that are not embedded and the low resistance part 3*b* come in contact with the sheet. Here, the separation auxiliary member 3 is in the second state. Therefore, the conveying resistance during the sheet conveyance is reduced further than that of the state illustrated in FIG. 5A, so that the amplification of the reaction force is suppressed. Accordingly, problems such as the feeding failure are prevented. In the case where a sheet with higher rigidity is conveyed, the separation auxiliary member 3 is in the third state in order to embed the entire high resistance part 3*a* in the inclined surfaces 2*a* and 2*b*.

As described above, the separation auxiliary member 3 has the first to third states and is selectively switched between the states according to the rigidity of the sheet during the sheet conveyance, thereby stably conveying a wide range of sheets. For example, it is assumed that in order to feed sheets such as transverse recycled papers that are very likely to cause double feeding, the high resistance part 3*a* of the separation auxiliary member 3 is formed to have a surface with a very high friction coefficient or a deeply uneven surface. Here, even when a sheet with very high rigidity such as a corrugated paper is fed, the state of the separation auxiliary member 3 is switched according to the rigidity of the sheet, and thus the sheet and the high resistance part 3*a* are in non-contact with each other, thereby implementing stable feeding.

Figure 6A:
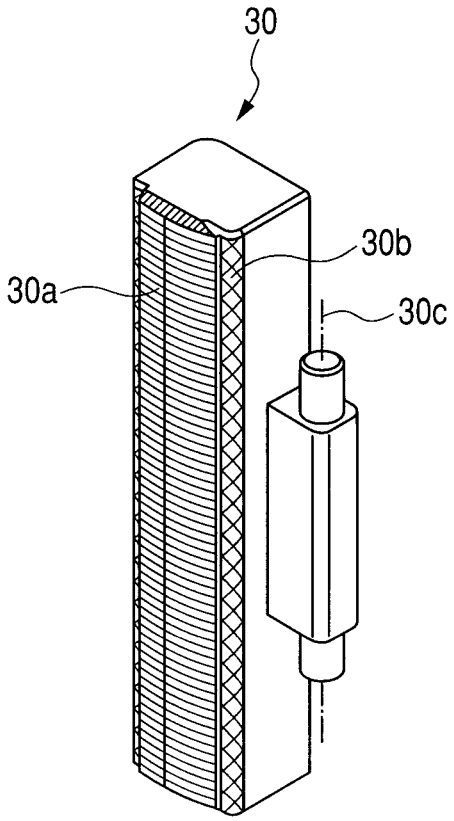
FIGS. 6A and 6B are diagrams illustrating a separation auxiliary member according to another embodiment.
Figure 6B:
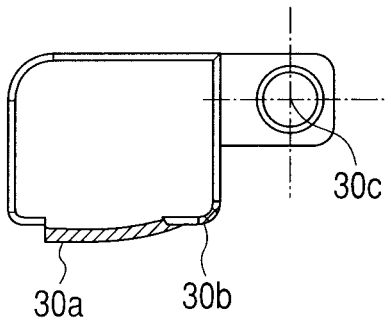

FIGS. 6A and 6B are diagrams illustrating a separation auxiliary member according to another embodiment. FIG. 6A is a perspective view, and FIG. 6B is a plan view. The separation auxiliary member 30 illustrated in FIGS. 6A and 6B includes a high resistance part 30*a*, a low resistance part 30*b*, and a rotation shaft 30*c*. The low resistance part 30*b* and the rotation shaft 30*c* have the same configurations as those of the above-mentioned low resistance part 3*b* and the rotation shaft 3*c*. The high resistance part 30*a* is configured as an uneven surface, and the uneven surface formed is broader than that of the above-mentioned high resistance part 3*a*. In addition, the depth of the unevenness of the high resistance part 30*a* is reduced toward the low resistance part 30*b*. Accordingly, when the separation auxiliary member 30 is switched between the above-mentioned first to third states, the resistance is smoothly changed during the sheet conveyance, thereby implementing more suitable feeding.

Next, a method of determining a condition for switching between the first to third states by the separation auxiliary member 3 or 30 will be described. The switching condition may be controlled arbitrarily by changing the biasing force of the biasing spring 9 which biases the separation auxiliary member 3 or 30.

Figure 7:
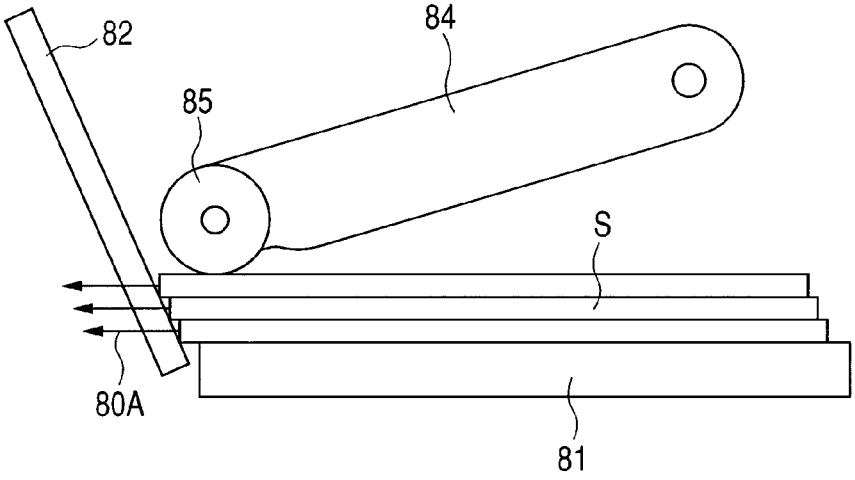
FIG. 7 is a schematic diagram of a feeding mechanism according to the embodiment of the invention.

FIG. 7 is a schematic diagram of a feeding mechanism according to the embodiment of the invention. The feeding mechanism illustrated in FIG. 7 includes a sheet feed tray 81, an inclined surface 82, a feeding roller arm 84, and a feeding roller 85. The sheet feed tray 81, the feeding roller arm 84, and the feeding roller respectively correspond to the above-mentioned sheet feed tray 1, the feeding roller arm 4, and the feeding roller 5. When feeding of the sheet S is started by the feeding roller 85, as illustrated in FIG. 7, a force 80A for pressing the inclined surface 82 is generated by the sheet S. The force 80A is a force changing with the flexural rigidity of the sheet in order to switch the separation auxiliary member 3 or 30 between the first to third states.

Figure 8:
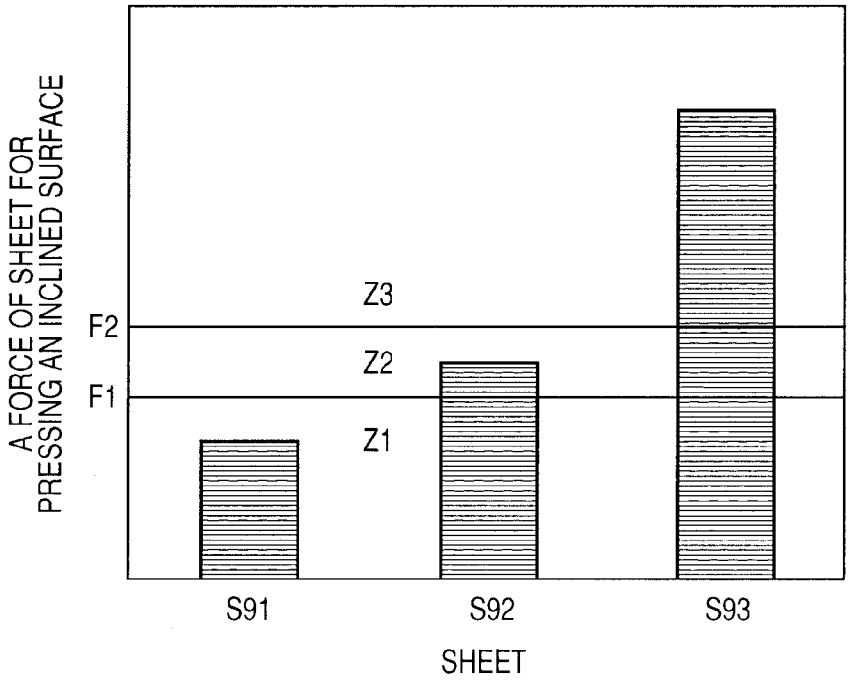
FIG. 8 is a graph showing a relationship between rigidity of a sheet and a force that the sheet exerts when pressing the inclined surface.

FIG. 8 is a graph showing a relationship between rigidity of a sheet and a force that the sheet exerts when pressing the inclined surface. The measurement results illustrated in FIG. 8 are all measured by the sheet feed mechanism illustrated in FIG. 7, and the inclined surface 82 is not provided with the above-mentioned high resistance part 3*a* or 30*a*. The friction coefficient of the inclined surface 82 is the same as that of the low resistance part 3*b* or 30*b*. In FIG. 8, a sheet S91 is a sheet of transverse recycled paper, a sheet S92 is a sheet of longitudinal paper (standard paper) of 65 g/cm$^2$, and a sheet S93 is a sheet of longitudinal paper (thick paper) of 105 g/cm$^2$. As shown in FIG. 8, it can be seen that the force 80A is greater as the rigidity of the sheet increases. That is, as the rigidity of the sheet increases, the force exerted on the inclined surface 82 when the sheets are in contact is increased.

Here, a status of separation and conveyance of each sheet will be described as follows.

First, double feeding of the sheet S91 occurs on the inclined surface 82. This is because the sheet S91 is the recycled paper and thus has a high coefficient of friction between sheets, and the sheet S91 is the transverse paper and thus has a low rigidity. That is, in the case where the sheet S91 is conveyed along the inclined surface 82, the reaction force against the feeding force is small, so that the uppermost sheet and the sheet disposed immediately thereunder cannot be separated from each other. Therefore, the high resistance part 3*a* or 30*a* which has a higher friction coefficient than that of the inclined surface 82 has to be provided to amplify the reaction force.

Next, the double feeding of the sheets S92 does not occur on the inclined surface 82, and the sheet S92 is stably fed even though the high resistance part 3*a* or 30*a* is provided. Lastly, although conveyance of the sheet S93 on the inclined surface 82 is possible, the rigidity of the sheet S93 is high and thus the reaction force is high, and the high resistance part 3*a* or 30*a* need not be provided.

According to the above results, in this embodiment of the invention, the biasing spring 9 is designed to have a biasing force to switch the separation auxiliary member 3 or 30 between the first, second, and third states depending on the sheets S91, S92, and S93. Specifically, as shown in FIG. 8, the biasing spring 9 is designed to have such a biasing force that regions Z1, Z2, and Z3 correspond to the first, second, and third states of the separation auxiliary member 3 or 30. The region Z1 is a region where the value of the force 80A is in the range of 0 to a threshold value F1, and the threshold value F1 is higher than the value of the sheet S91 and lower than the value of the sheet S92. In addition, the region Z2 is a region where the force 80A is in the range of the threshold value F1 to a threshold value F2, and the threshold value F2 is higher than the value of the sheet S92 and lower than the value of the sheet S93. In addition, the region Z3 is a region where the value of the force 80A is greater than the threshold value F2.

As described above, as the biasing spring 9 is designed to have such a biasing force, during conveyance of the sheet S91, the sheet S91 comes in contact with the high resistance part 3*a* or 30*a*, and during conveyance of the sheet S93, the sheet S93 and the high resistance part 3*a* or 30*a* are completely in non-contact with each other. In addition, during conveyance of the sheet S92, the sheet S92 comes in contact with the portion of the high resistance part 3*a* or 30*a* and the low resistance part 3*b* or 30*b*. As such, the feeding device which stably feeds a wide range of sheets from the transverse recycled paper to the thick paper is implemented.

Next, an image forming apparatus according to the embodiment of the invention will be described.

Figure 9:
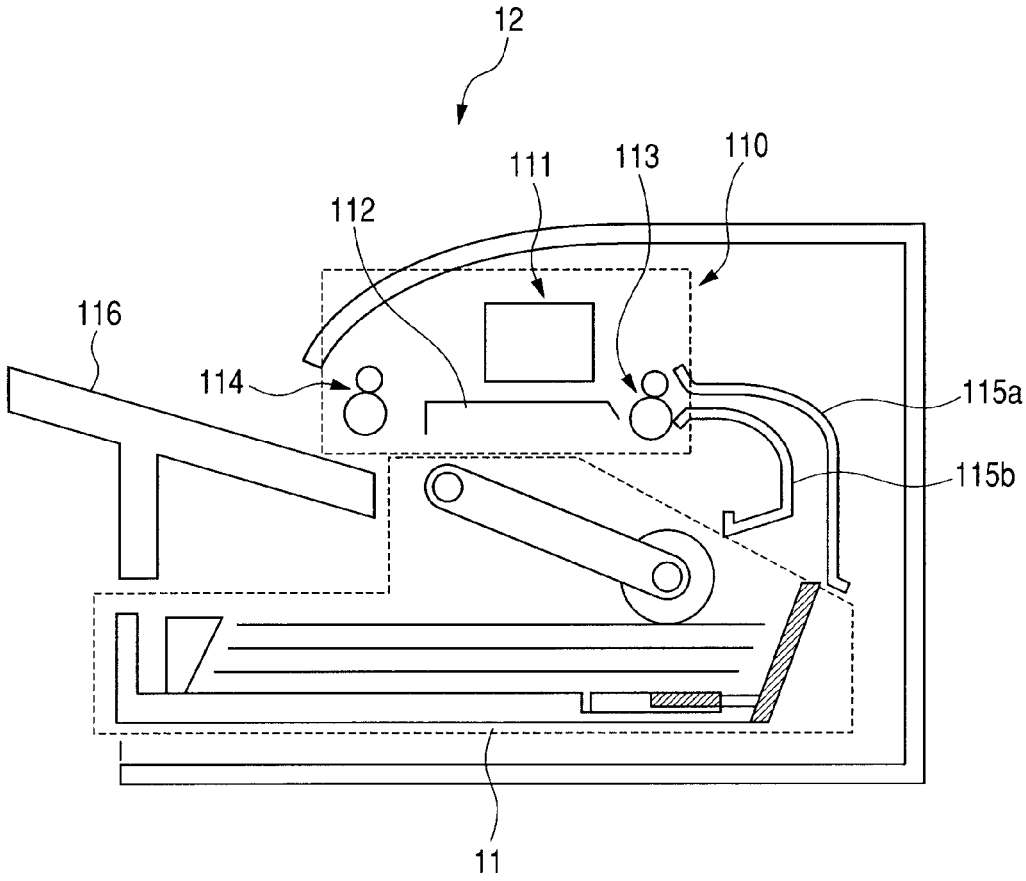
FIG. 9 is a diagram illustrating an image forming apparatus according to the embodiment of the invention.
Figure 10:
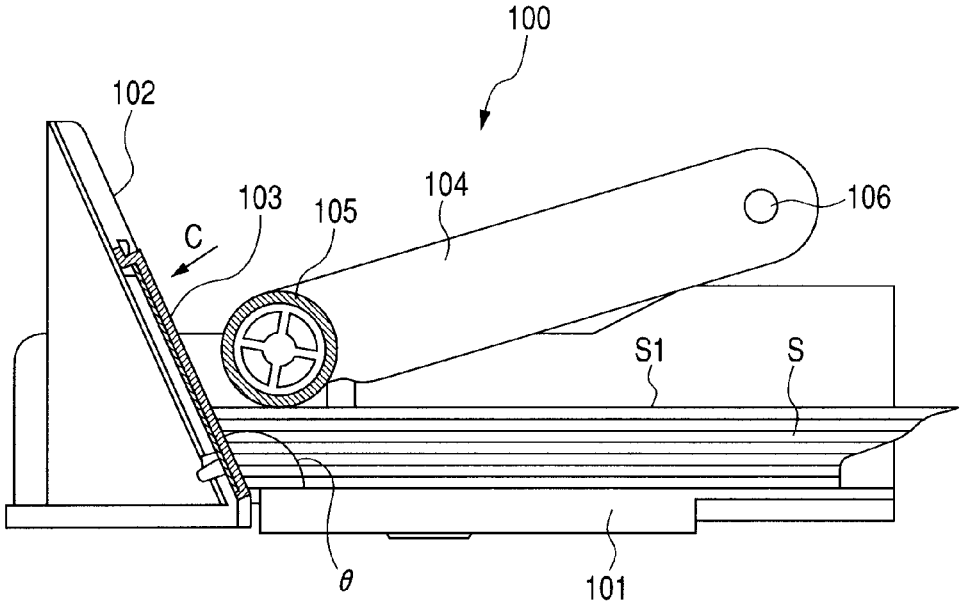
FIG. 10 is a cross-sectional view illustrating the configuration of an inclined surface separation-type feeding device according to a related art.
Figure 11:
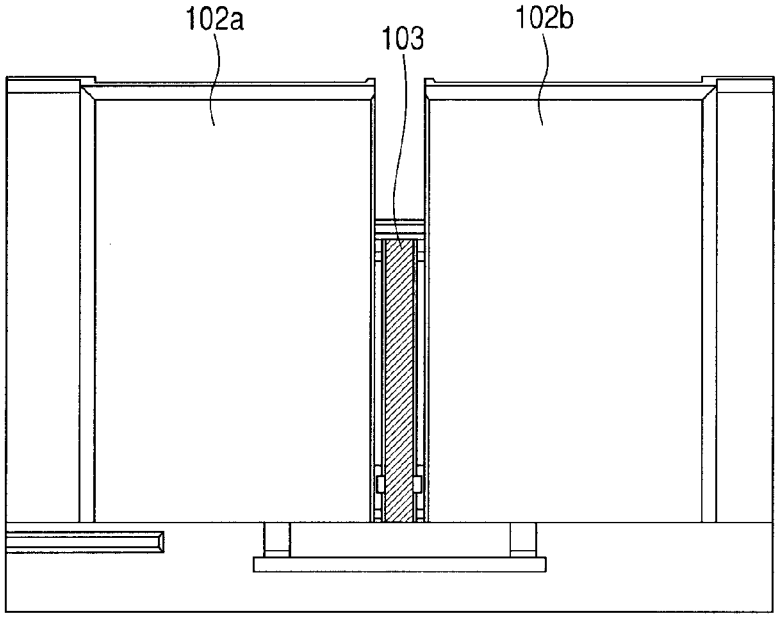
FIG. 11 is a plan view of a separation plate and a separation auxiliary member illustrated in FIG. 10.

FIG. 9 is a diagram illustrating the image forming apparatus according to the embodiment of the invention. The image forming apparatus 12 illustrated in FIG. 9 has the feeding device 11, an image forming unit 110, and a sheet discharge tray 116. In addition, in FIG. 9, only a schematic part of the feeding device 11 is shown. The image forming unit 110 includes a print head 111, a platen 112, a pair of register rollers 113, and a pair of sheet discharge rollers 114.

In the image forming apparatus 12, for a sheet conveyed from the feeding device 11, a conveying path of the sheet is restricted by an outer guide 115*a* and an inner guide 115*b*. Accordingly, the sheet is smoothly guided to the image forming unit 110. In addition, the sheet on which an image is formed by the image forming unit 110 is discharged and stacked in the sheet discharge tray 116.

Next, operations of the image forming unit 110 will be described. The sheet guided by the outer guide 115*a* and the inner guide 115*b* is nipped between the pair of register rollers 113. Thereafter, the sheet is conveyed toward the print head 111 by the pair of the register rollers 113 and is intermittently conveyed by an accurate movement amount during image formation. The print head 111 is reciprocated by a carriage (not shown) in a direction perpendicular to the transportation direction of the sheet, that is, in the width direction of the sheet and discharges ink droplets to form an image. Here, the platen 112 suitably holds the image formation surface of the sheet. When the image formation is completed, the sheet is discharged to the sheet discharge tray 116 by the pair of discharge rollers 114.

In the image forming apparatus 12, the sheet is stably guided to the image forming unit 110 by the feeding device 11 regardless of the rigidity of the sheet. Therefore, the image formation is properly performed regardless of the rigidity of the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-270127, filed Nov. 27, 2009, which is hereby incorporated by reference herein in its entirety.

What is claimed is:

1. A feeding device comprising:

a storage unit in which sheets are loaded and stored;

a feeding roller which rotates while contacting the uppermost sheet stored in the storage unit to move the uppermost sheet forward;

a separation plate which is disposed forward in the movement direction of the uppermost sheet and, the separation plate is provided with an inclined surface that is inclined with respect to the movement direction; and a separation auxiliary member which is disposed along the inclined surface of the separation plate, the separation auxiliary member is disposed apart from the feeding roller, and the separation auxiliary member has a first resistance part and a second resistance part which has a lower friction coefficient than that of the first resistance part, wherein a friction coefficient of the first resistance part and the second resistance part are higher than that of the inclined surface, wherein the first resistance part and the second resistance part are arranged in the width direction of the sheet, and wherein the separation auxiliary member rotates from an initial position where the first resistance part projecting from the inclined surface to an embedded position where the first resistance part embedded in the inclined surface and the second resistance part comes in contact with the sheet according to a rigidity of the sheet when a front end of the sheet fed by the feeding roller contacts the separation auxiliary member.

2. The feeding device according to claim 1, wherein the separation auxiliary member further includes:

a biasing unit for exerting a biasing force against the received force to bias the first and second resistance parts so as to switch the separation auxiliary member between the initial position, a second position where the first resistance part and the second resistance part come in contact with the sheet, and the embedded position according to a rigidity of the sheet when a front end of the sheet fed by the feeding roller contacts the separation auxiliary member.

3. The feeding device according to claim 2, wherein the first resistance part consists of an uneven surface so that a depth of unevenness is reduced toward the second resistance part.

4. The feeding device according to claim 2, wherein when a front end of the sheet fed by the feeding roller contacts the separation auxiliary member, the separation auxiliary member is in the initial position when the sheet has a first rigidity, the separation auxiliary member is in the second position when the sheet has a second rigidity higher than the first rigidity, and the separation auxiliary member is in the embedded position when the sheet has a third rigidity higher than the second rigidity.

5. An image forming apparatus having the feeding device according to claim 1, and an image forming unit for forming an image on a sheet fed from the feeding device.

6. The feeding device according to claim 1, wherein the separation auxiliary member does not nip the sheet in corporation with the feeding roller.

* * * * *